US006446657B1

(12) United States Patent
Dziorny et al.

(10) Patent No.: US 6,446,657 B1
(45) Date of Patent: Sep. 10, 2002

(54) AIRCRAFT AIR CONTROL VALVE APPARATUS

(75) Inventors: Paul J. Dziorny, Mt. Airy, MD (US); Benjamin D. Sellers, Towson, MD (US)

(73) Assignee: Fairchild Controls Corporation, Frederick, MD (US)

( * ) Notice: Subject to any disclaimer, the term of this patent is extended or adjusted under 35 U.S.C. 154(b) by 0 days.

(21) Appl. No.: 09/736,314

(22) Filed: Dec. 15, 2000

(51) Int. Cl.[7] ..... F16K 31/122
(52) U.S. Cl. ..... 137/219; 137/614.21
(58) Field of Search ..... 137/219, 614.21

(56) References Cited

U.S. PATENT DOCUMENTS

| | | | | | |
|---|---|---|---|---|---|
| 1,387,446 | A | * | 8/1921 | Astier | 137/219 |
| 2,085,893 | A | * | 7/1937 | Boland | 137/219 |
| 2,592,474 | A | * | 4/1952 | Schnyder | 137/219 |
| 2,713,350 | A | * | 7/1955 | Payne | 137/219 |
| 3,155,108 | A | * | 11/1964 | Kahn et al. | 137/614.21 |
| 3,297,047 | A | * | 1/1967 | Sime | 137/220 |
| 3,380,469 | A | * | 4/1968 | Salerno et al. | 137/219 |
| 3,399,690 | A | * | 9/1968 | Guy | 137/220 |
| 3,587,622 | A | * | 6/1971 | Hardison | 137/220 |
| 3,865,128 | A | * | 2/1975 | Zadoo | 137/220 |
| 4,437,485 | A | * | 3/1984 | Goodman | 137/220 |
| 5,285,715 | A | * | 2/1994 | Elrod et al. | 137/625.64 |
| 5,887,618 | A | * | 3/1999 | Grundby et al. | 137/596.18 |

FOREIGN PATENT DOCUMENTS

| | | | | |
|---|---|---|---|---|
| GB | 973192 | * | 10/1964 | 137/220 |

* cited by examiner

*Primary Examiner*—Gerald A. Michalsky
(74) *Attorney, Agent, or Firm*—Michael W. York

(57) ABSTRACT

Aircraft air control valve apparatus for controlling the flow of pressurized aircraft engine bleed air. The control valve apparatus includes a hollow housing with two end portions with each end portion having an aperture located therein with one end portion being connected to a source of pressurized aircraft engine bleed air. A shut-off valve is located in one end portion of the hollow housing for starting and stopping the flow of pressurized aircraft engine bleed air through the hollow housing and a modulating valve is located in the other end portion of the hollow housing for modulating the flow of pressurized aircraft engine bleed air through the hollow housing. The shut-off valve and the modulating valve are operated by the use of pressurized aircraft engine bleed air.

13 Claims, 3 Drawing Sheets

AIRCRAFT AIR CONTROL VALVE APPARATUS

BACKGROUND OF THE INVENTION

Valves and the like that are used to control fluids such as gases in aircraft and spacecraft are exposed to conditions that place demands upon them that are not present in normal environments in which the majority of valves operate. For instance, valves that are used in aircraft and spacecraft can be subjected to extreme temperature variations that in many cases would cause normal valves to cease to function or to cease to function properly. For instance, low temperatures coupled with humidity that can be found in many aircraft situations can result in the formation of ice that can cause a valve to directly or indirectly freeze up and fail to function.

Valves that are used in aircraft and spacecraft are also subjected to possible severe forces as the aircraft or spacecraft maneuvers or departs from the ground. This can result in the distortion of valve components and can produce malfunctioning of the valve or at least cause increased wear on components of the valve that will eventually cause the valve to fail. Also, many valves on aircraft and spacecraft are operated by fluids located on the aircraft or spacecraft and such fluids must be used sparingly in most cases. This means that the valve must be efficient in its use of the operating fluid.

Since safety is of extreme importance in aircraft and spacecraft, it is essential that the valve used on such craft be extremely reliable. Usually reliability is increased by making the valve simple in its operation with a minimum of parts that can fail.

The present control valve apparatus is used with a source of engine bleed air on an aircraft such as an airliner. In this use bleed air is used to operate a valve to control the amount of bleed air that is allowed to pass into the inlet portion of an air turbine that is located on the aircraft.

In the past, with such units shut-off and modulation was either accomplished with butterfly valves or complex variable inlet guide vanes. Unfortunately, butterfly valves are not entirely satisfactory. Butterfly valves result in severe flow distortion during throttling, with significantly greater noise levels. They also result in significantly greater pressure drop at low inlet pressures. Significant ice breaking capacity on a typical butterfly valve requires large actuators attached to the valve body with a corresponding large overhanging moment.

These problems are overcome with the present aircraft air control apparatus. For effective and safe use on aircraft the aircraft air control apparatus is compact and uses simple integration of a shut off valve and a modulating valve and has very high ice-breaking capacity allowing the valve to open and modulate after heavy ice build-up. The aircraft air control apparatus also has a low pressure drop through both the shut-off and modulating sections or elements of the assembly permitting air drive unit operation at low bleed air pressure and it also has low noise at extreme throttling conditions.

SUMMARY OF THE INVENTION

This invention relates to air flow control and more particularly to air flow control on aircraft.

Accordingly, it is an object of the invention to provide an aircraft air control valve apparatus.

It is an object of the invention to provide an aircraft air control valve apparatus having a plurality of functions.

It is an object of the invention to provide an aircraft air control valve apparatus with both modulating and shut off functions.

It is an object of the invention to provide an aircraft air control valve apparatus that compactly incorporates both modulating and shut off functions in one valve unit.

It is an object of the invention to provide an aircraft air control valve apparatus that readily operates with available aircraft engine bleed air.

It is an object of the invention to provide an aircraft air control valve apparatus that allows both modulating and shut off functions after heavy ice build up on the aircraft air control valve apparatus.

It is an object of the invention to provide an aircraft air control valve apparatus having low pressure drop associated with both the modulating and shut off functions.

It is an object of the invention to provide an aircraft air control valve apparatus that has low noise.

It is an object of the invention to provide an aircraft air control valve apparatus that has low noise at extreme throttling conditions.

It is an object of the invention to provide an aircraft air control valve apparatus that is simple in its design.

It is an object of the invention to provide an aircraft air control valve apparatus that is simple in its operation.

It is an object of the invention to provide an aircraft air control valve apparatus that has similar parts.

It is an object of the invention to provide an aircraft air control valve apparatus that has parts that serve multiple functions.

It is an object of the invention to provide an aircraft air control valve apparatus that uses a common housing for multiple functions.

It is an object of the invention to provide an aircraft air control valve apparatus that uses a common shaft for multiple functions.

It is an object of the invention to provide an aircraft air control valve apparatus that is reliable in its operation.

It is an object of the invention to provide an aircraft air control valve apparatus that is easy to manufacture.

It is an object of the invention to provide an aircraft air control valve apparatus that is easy to service.

It is an object of the invention to provide an aircraft air control valve apparatus that is easy to repair.

It is an object of the invention to provide an aircraft air control valve apparatus that replaces existing less desirable butterfly valves.

It is an object of the invention to provide fluid control valve apparatus with multiple applications.

These and other objects of the invention will be apparent from the following described aircraft fluid control valve apparatus invention that has a hollow housing having two end portions and valve apparatus located at both end portions of the housing. A shut-off valve is located in one end portion of the hollow housing for starting and stopping the flow of fluid through said hollow housing and a modulating valve is located in the other end portion of the hollow housing for modulating the flow of fluid through the hollow housing.

BRIEF DESCRIPTION OF THE DRAWINGS

The invention will be hereinafter more fully described with reference to the accompanying drawings in which.

DETAILED DESCRIPTION OF THE PREFERRED EMBODIMENT

Figure 1:
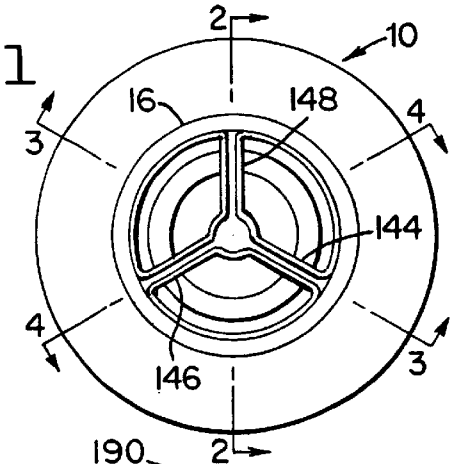
FIG. 1 is an end elevational view of the aircraft air control valve apparatus invention.
Figure 2:
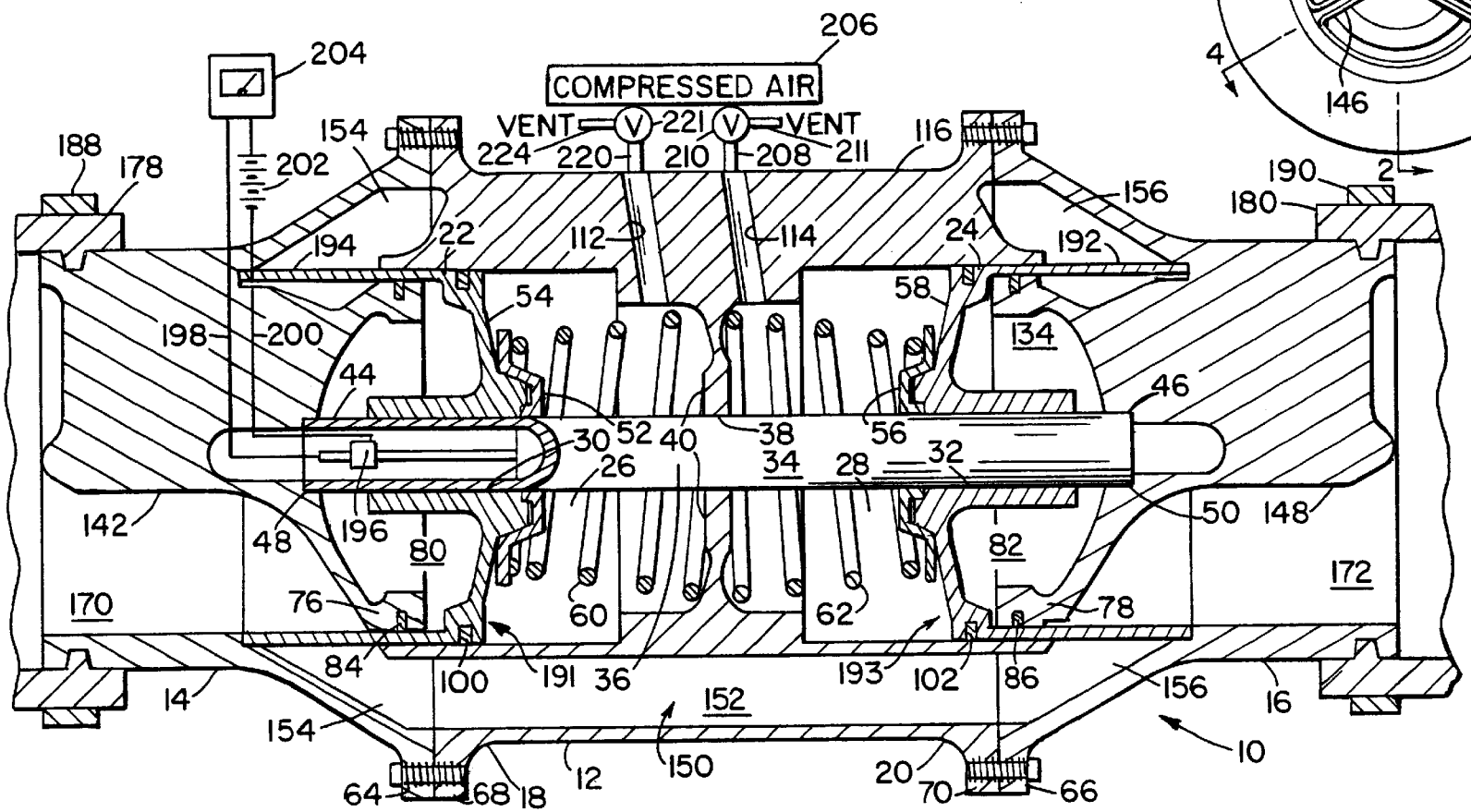
FIG. 2 is an enlarged sectional view of the aircraft air control valve apparatus set forth in FIG. 1 taken substantially on the line 2—2 thereof.

The aircraft air control valve apparatus is illustrated in FIGS. 1 and 2 and is designated generally by the number 10. The aircraft air control valve apparatus 10 comprises a cylindrical shaped central housing 12, two similarly configured end caps 14 and 16 on opposing ends 18 and 20 of the housing 12 and two similarly configured pistons 22 and 24 installed within respective cylindrical circular cross section bores 26 and 28 in the the central housing 12. Each piston 22 and 24 has a centrally located circular shaped cross section aperture 30 and 32 that accepts a circular shaped cross sectional rod 34 so that the pistons 22 and 24 can ride upon and reciprocate back and forth along the rod 34. The central rod portion 36 is held in place in a centrally located circular cross section aperture 38 that is located in an inward projecting flange 40 in the interior of the housing 12. The respective end portions 44 and 46 of the rod 34 are also secured in the respective apertures 48 and 50 in the respective end caps 14 and 16.

A disk shaped spring holder 52 is located on the face 54 of the piston 22 and an identical disk shaped spring holder 56 is located on the face 58 of the piston 24. A truncated conical shaped compression spring 60 is located within the bore 26 and an identical compression spring 62 is also located within the bore 28. The compression spring 60 has one end in contact with the spring holder 52 and the other end in contact with the stationary flange 40 and hence this spring 60 biases the piston 22 in an outward direction or toward the end cap 14. In a similar manner, the compression spring 62 has one end in contact with the spring holder 56 and the other end in contact with the stationary flange 40 and hence this spring 62 biases the piston 24 in an outward direction or toward the end cap 16.

As indicated in FIG. 2, each end cap 14 and 16 has a respective circular flange 64 and 66 and its outer periphery that is sized and shaped to match respective flanges 68 and 70 located on the outer circumference of the respective end portions 18 and 20 of the central housing 12. Each end cap 14 and 16 has a respective cylindrical portion 76 and 78 that is sized and shaped to be a sliding fit within the respective interior cylindrical hollow portion 80 and 82 in the respective pistons 22 and 24.

It will be noted that the cylindrical portions 76 and 78 of the respective end caps 14 and 16 each have respective ring shaped sealing rings 84 and 86 that are located within circumferential grooves in the outer exterior surfaces of the respective cylindrical portions 76 and 78. These sealing rings 84 and 86 provide a seal between the respective cylindrical portions 76 and 78 and the adjacently located inner surfaces of the respective hollow portions 80 and 82 of the respective pistons 22 and 24. The forward outer periphery of each piston 22 and 24 has the respective ring shaped sealing rings 100 and 102 that are located within circumferential grooves. These sealing rings 100 and 102 provide a seal between the forward outer periphery of the respective pistons 22 and 24 and the cylindrical walls of the respective cylinders or bores 26 and 28.

Figure 3:
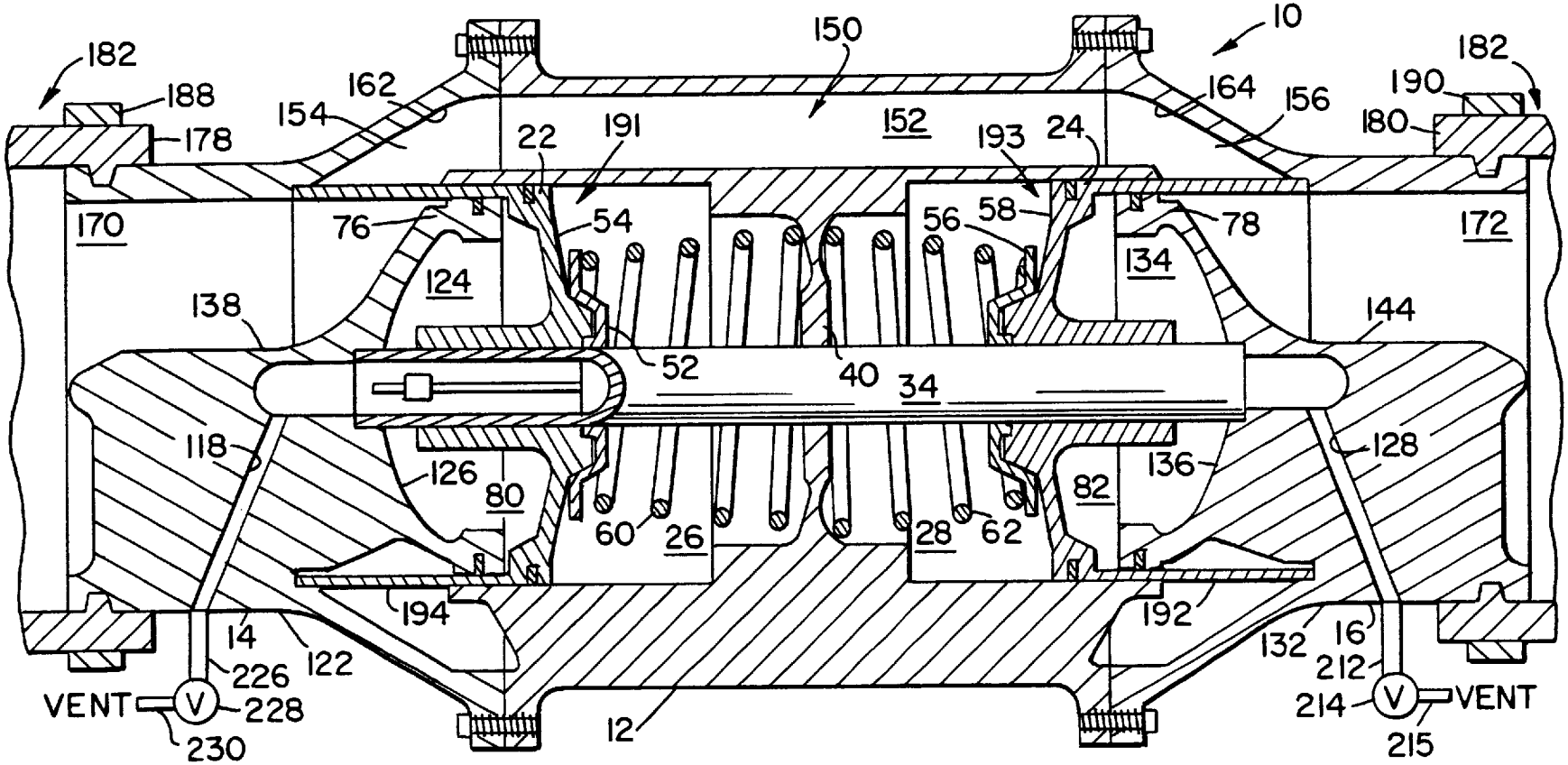
FIG. 3 is an enlarged sectional view of the aircraft air control valve apparatus set forth in FIG. 1 taken substantially on the line 3—3 thereof.
Figure 4:
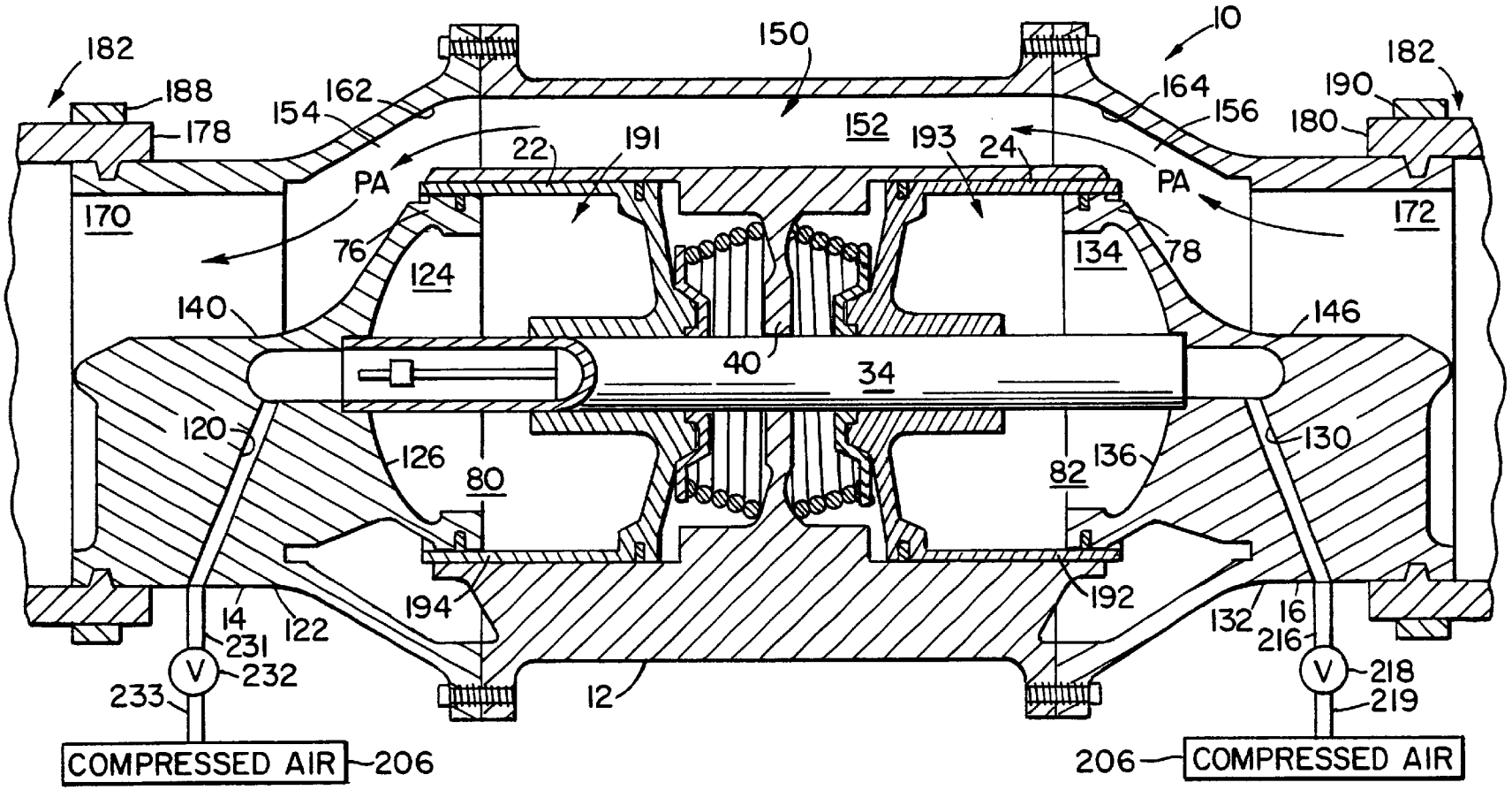
FIG. 4 is an enlarged sectional view of the aircraft air control valve apparatus set forth in FIG. 1 taken substantially on the line 4—4 thereof illustrating the shut off valve portion in the open position and the modulating valve portion in the in use position.

As indicated in FIG. 2, the housing 12 has two apertures 112 and 114 extending from the outside surface 116 of the housing 12 into the respective cylinder bores or chambers 26 and 28. Also as indicated in FIGS. 3 and 4, the end cap 14 has two apertures 118 and 120 extending from its exterior surface 122 into the chamber 124 formed by the hollow portion 80 of the piston 22 and the depressed curved surface 126 of the adjacently located cylindrical portion 76 of the end cap 14. In a similar manner, the end cap 16 has two apertures 128 and 130 extending from its exterior surface 132 into the chamber 134 formed by the hollow portion 82 of the piston 24 and the depressed curved surface 136 of the adjacently located cylindrical portion 78 of the end cap 16.

As illustrated in FIGS. 1, 2, 3 and 4, the end cap 14 has three supports 138, 140, and 142 that connect the cylindrical portion 76 of the end cap 14 to the exterior surface 122 of the end cap 14. It will be noted that the apertures 118 and 120 pass through the respective supports 138 and 140. In a similar manner, the end cap 16 has three supports 144, 146 and 148 that are identical to the supports 138, 140, and 142 of the end cap 14 and these supports 144, 146 and 148 connect the cylindrical portion 78 of the end cap 16 to the exterior surface 132 of the end cap 16. The apertures 128 and 130 in the end cap 16 also extend through the respective supports 144 and 146 in a manner that is identical to that for the apertures 118 and 120 that pass through the supports 138 and 140 of the end cap 14.

The air control valve apparatus 10 has an internal circumferential passage 150 that includes a circumferential passage 152 in the central housing portion 12 and the outer circumferential passages 154 and 156 in the respective inboard portions of the end caps 14 and 16. These passages 154 and 156 have outer tapering walls 162 and 164 that taper inward to the walls 166 and 168 of the respective apertures 170 and 172 of the outboard portions of the respective end caps 14 and 16. The outboard portions of the end caps 14 and 16 are sized to fit within the hollow end portions 178 and 180 of an air conduit 182 so the hollow interiors of the respective end portions 178 and 180 are in fluid communication with the respective apertures 170 and 172 of the outboard portions of the end caps 14 and 16. It will be noted that clamps 188 and 190 are used to secure the end portions 178 and 180 of the air conduit 182 to the outboard portions of the end caps 14 and 16.

As illustrated in FIGS. 3 and 4, the piston 24 and the associated end cap 16 form a shut off valve 193 and the piston 24 performs the dual function of being both the actuator and the valve member. In this connection, pressure in the hollow portion 82 of the piston 24 results in activation of the piston 24 and the cylindrical wall portion 192 of the piston 24 acts as a valve member since, as indicated, it blocks the passage of air from the aperture 172 of the outboard portion of the end cap 16 into aperture 156 and the associated circumferential passage 152 in the central housing portion 12.

As also illustrated in FIGS. 3 and 4, the piston 22 and the associated end cap 14 form a throttling valve 191 and the piston 22 also performs the dual function of being both the actuator and the valve member. In this connection, the amount of flow of pressurized fluid, such as air, from the chamber or passage 152 in the central housing portion 12 and in the aperture or chamber 154 in the inboard portion of the end cap 14 into the aperture 170 of the outboard portion of the end cap 14 is controlled by the position of the piston 22 and its cylindrical wall portion 194. Since the piston 22 serves as part of a modulating valve 191 it has a connected potentiometer 196 and hence the position of the piston 22 can be determined and hence the degree of modulation or restriction of the air passing by the piston 22. This potentiometer 196 is connected via the lead 198, the lead 200 and the battery 202 to a meter 204 or some other measuring device so that the position of the piston 22 is readily determined.

As indicated in FIG. 2, the passage 114 in the central housing portion 12 is connected to a source of pressurized or compressed air 206 which in the preferred embodiment is aircraft engine bleed air, by the hollow conduit 208 and a valve 210 in order that pressurized air can be supplied to the cylinder 28. Through the use of the valve 210 the conduit 208 and hence the cylinder 28 can also be vented through the vent conduit 211. As indicated in FIG. 3, the passage or aperture 128 in the end cap 16 is connected to a hollow conduit 212 which is in turn connected to a valve 214 that can be opened to vent the conduits 128 and 212 and the connected chamber 134 through the vent conduit 215. As indicated in FIG. 4, the passage 130 in the end cap 16 is connected to a hollow conduit 216 that is connected to the source of pressurized air 206 through the valve 218 and the conduit 219 and hence the connected chamber 134 can be pressurized by opening this valve 218.

As indicated in FIG. 2, the aperture 112 in the central housing portion 12 is connected to a hollow conduit 220, to a valve 221 and then to the source of pressurized air 206 or alternatively the valve 221 can be vented via the hollow conduit 224. In this manner the bore or chamber 26 can be either pressurized or vented. As illustrated in FIG. 3, the aperture 118 in the end cap 14 is connected to a hollow conduit 226 that is in turn connected to a valve 228 and then a hollow conduit 230 that is in turn is connected to a vent line 233. As illustrated in FIG. 4, the aperture 120 in the end cap 14 is connected to a hollow conduit 231 that is connected to a valve 232 that in turn connected to the source of pressurized air 206. In view of this arrangement, the chamber 124 can be pressurized or vented through the action of the valve members 228 and 232.

The control valve apparatus 10 is manufactured using manufacturing operations and techniques known in the art. The housing 12 and the end caps 14 and 16 are formed by suitable casting techniques known in the art from aluminum and by using known machining techniques. In addition, the pistons 22 and 24 are manufactured in a similar manner. All of the sealing rings, such as the rings 84, 86, 100, and 102, and other such items are standard items and the same is true of the various hollow conduits, such as the conduits 208 and 212 and the various valves such as the valve 210 as well as the potentiometer 196 and associated items. The assembly of the control valve apparatus is straight forward and involves known assembly techniques including the use of various bolts.

The control valve apparatus 10 is used in the following manner. The valve apparatus 10 is connected to a conduit such as the conduit 182 that is connected to the source of pressurized air 206 which in the preferred embodiment is aircraft engine bleed air. In connecting the control valve apparatus 10 the outboard portions of the end caps 14 and 16 are connected to the respective end portions 178 and 180 of the air conduit 182 so that the flow of pressurized air flows into the end cap 16 and out of the end cap 14. In making these connections, the clamps 188 and 190 are used to secure the end portions 178 and 180 of the air conduit 182 to the respective outboard portions of the end caps 14 and 16.

When the control valve apparatus 10 is not being subjected to any outside control forces, the pistons 22 and 24 are both biased in their outward directions or toward the respective associated end cap members 14 and 16 by the force exerted by the respective springs 60 and 62. In this position, the skirt or cylindrical wall portion 192 of the piston 24 blocks the passage of air from the aperture 172 into the aperture 156 and the skirt or cylindrical wall portion 194 of the piston 22 blocks the flow of air from the passage 152 in the central housing portion 12 into the aperture 170 in the end cap 14. Consequently both the modulating valve 191 and the shut off valve 193 are in their closed positions.

In order to operate the shut off valve formed by the piston 24 and the associated end cap 16, the valve 210 is turned to its vented position so that the conduit 208 and the cylinder 28 is vented. The valve 218 would then be opened to permit the passage of pressurized air from the source of pressurized air 206 through the valve 218, the conduit 216 and the passage 130 into the chamber 134. The pressurized air in the chamber 134 applies force to the piston 24 to overcome the force of the spring 62 and move the piston 24 toward the flange 40 in the center of the housing 12. As indicated in FIG. 4, this movement of the piston 24 results in the movement of the cylindrical wall portion 192 of the piston 24 so that the wall portion 192 no longer blocks the passage of pressurized air from the aperture 172 in the end cap 16 into the aperture 156. Consequently, with the piston 24 in this position, the shut off valve 193 formed by the piston 24 and the associated end cap 16, is in its open position and pressurized air can pass from the conduit 180 through the shut off valve formed by the piston 24 and the associated end cap 16 and into the passages 156 and 152 as indicated by the arrows labeled PA.

To then close the shut off valve 193, it is necessary to reduce the pressure in the chamber 134 behind the piston 24. To do this, the valve 214 is turned to the vent position so that compressed air passes from the chamber 134 through the passage 128, the passage 212, the valve 214 and the vent tube 215.

In order to operate the modulating valve formed by the piston 22 and the associated end cap 14, the valve 221 is turned to its vented position so that the conduit 220 and the cylinder 26 is vented. The valve 232 would then be opened to permit the passage of compressed or pressurized air from the source of compressed air 206 through the valve 232, the conduit 231 and the passage 120 into the chamber 124. The pressurized air in the chamber 124 applies force to the piston 22 to overcome the force of the spring 60 and move the piston 22 toward the flange 40 in the center of the housing 12. As indicated in FIG. 4, this movement of the piston 22 results in the movement of the cylindrical wall portion 194 of the piston 22 so that the wall portion 192 no longer blocks the passage of pressurized air between the aperture 170 in the outboard portion of the end cap 14 and the apertures 154 and 152. Consequently, with the piston 22 in this position, the modulating valve 191 formed by the piston 22 and the associated end cap 14, is in its open position and pressurized air can pass from the conduits or passages 152 and 154 through the modulating valve formed by the piston 22 and the associated end cap 14 and into the passage 170 as indicated by the arrows labeled PA. The desired degree of modulation of the modulating valve 191 can be obtained through the appropriate use of the valves 221 and 232 and the degree of modulation can be determined from the potentiometer 196 that is connected to the piston 22.

To obtain the desired degree of modulation, it may be necessary to reduce the pressure in the chamber 124 behind the piston 22. To do this, the valve 228 is turned to the vent position so that compressed air passes from the chamber 124 through the passage 118, the passage 226, the valve 228 and the vent tube 230.

It should be noted that the pistons 22 and 24 are interchangeable and hence this simplifies the repair parts and parts supply situations.

Although the invention has been described in considerable detail with reference to a certain preferred embodiment, it will be understood that variations or modifications may be made within the spirit and scope of the invention as defined in the appended claims.

What is claimed is:

1. Control valve apparatus for controlling the flow of a fluid comprising a hollow housing with a rod located therein, said hollow housing having a passage way for fluid being controlled and two end portions, shut off valve means located in one end portion of said hollow housing for starting and stopping the flow of fluid in the passage way for fluid being controlled in said hollow housing, said shut off valve means comprising a piston member with an aperture extending therethrough sized to accept said rod, said piston member of said shut off valve means being located for reciprocating movement on said rod with the aperture in said piston member receiving said rod, modulating valve means located in the other end portion of said hollow housing for modulating the flow of fluid in the passage way for fluid being controlled in said hollow housing, said modulating valve means comprising a piston member with an aperture extending therethrough sized to accept said rod, said piston member of said modulating valve means being located for reciprocating movement on said rod with the aperture in said piston member receiving said rod and control means associated with said piston member of said shut off valve means and said piston member of said modulating valve means for separately controlling the reciprocating movement of said piston member of said shut off valve means and said piston member of said modulating valve means, said control means comprising two fluid chambers located within said hollow housing for controlling the position of said piston member of said shut off valve means and two fluid chambers located within said hollow housing for controlling the position of said piston member of said said modulating valve means with said piston member of said shut off valve means forming a portion of both fluid chambers for controlling the position of said piston member of said shut off valve means and said piston member of said modulating valve means forming a portion of both fluid chambers for controlling the position of said piston member of said modulating valve means.

2. The control valve apparatus of claim 1 wherein a portion of each of said piston members of said shut off valve means and said modulating valve means are located to be movable to block at least a portion of the passage way for fluid being controlled.

3. The control valve apparatus of claim 2 wherein each of said piston members has a skirt portion and the portion of each of said piston members of said shut off valve means and said modulating valve means located to be movable to block at least a portion of the passage way for fluid being controlled is the skirt portion.

4. The control valve apparatus of claim 1 wherein said control means includes a passage in fluid communication with each of said fluid chambers.

5. The control valve apparatus of claim 4 wherein said control means includes means for venting each of said fluid chambers connected to each of said fluid chambers.

6. The control valve apparatus of claim 5 further comprising indicating means associated with said piston member of said modulating valve means for indicating the position of said piston member of said modulating valve means.

7. The control valve apparatus of claim 6 wherein said indicating means for indicating the position of said piston member of said modulating valve mean comprises a potentiometer.

8. The control valve apparatus of claim 6 further comprises biasing means for biasing said shut off valve means and said modulating valve means in closed positions.

9. The control valve apparatus of claim 8 wherein said biasing means comprises a spring for exerting a force on said piston member of said said shut off valve means and a spring for exerting a force on said piston member of said modulating valve means.

10. The control valve apparatus of claim 5 wherein said control means further comprises a fluid source.

11. The control valve apparatus of claim 10 wherein said fluid source comprises a compressed air source.

12. The control valve apparatus of claim 11 wherein said piston members of said shut off valve means and said modulating valve means are interchangeable.

13. The control valve apparatus of claim 12 further comprising seals associated with said piston member of said shut off valve means and said said piston member of said modulating valve means.

* * * * *